US005657610A

United States Patent [19]

Dietrich et al.

[11] Patent Number: 5,657,610

[45] Date of Patent: Aug. 19, 1997

[54] PACKAGING MACHINE

[75] Inventors: Walter Dietrich, Weinstadt; Manfred Hermann, Korb; Guenter Loew, Waiblingen; Eberhard Krieger, Weinstadt, all of Germany

[73] Assignee: Robert Bosch GmbH, Stuttgart, Germany

[21] Appl. No.: 569,213

[22] PCT Filed: May 4, 1995

[86] PCT No.: PCT/DE95/00586

§ 371 Date: Dec. 15, 1995

§ 102(e) Date: Dec. 15, 1995

[87] PCT Pub. No.: WO95/31372

PCT Pub. Date: Nov. 23, 1995

[30] Foreign Application Priority Data

May 13, 1994 [DE] Germany ..... 44 16 891.8

[51] Int. Cl.[6] ..... B65B 61/16; B65B 43/26

[52] U.S. Cl. ..... 53/139.5; 53/566; 53/252; 493/312

[58] Field of Search ..... 53/564, 566, 252, 53/139.5; 493/312, 313, 315, 316, 317; 206/485, 486, 489

[56] References Cited

U.S. PATENT DOCUMENTS

| | | | |
|---|---|---|---|
| 4,833,860 | 5/1989 | Hartness | 53/539 |
| 5,175,976 | 1/1993 | Petry et al. | 53/566 |
| 5,402,889 | 4/1995 | Hermann et al. | 206/485 |
| 5,544,755 | 8/1996 | Paumen et al. | 206/485 |

FOREIGN PATENT DOCUMENTS

| | | | |
|---|---|---|---|
| 01346290A2 | 3/1985 | European Pat. Off. | B65B 23/22 |
| 0465437 | 5/1991 | European Pat. Off. . | |
| 4309036 | 3/1993 | Germany . | |

*Primary Examiner*—Linda Johnson
*Assistant Examiner*—John Paradiso
*Attorney, Agent, or Firm*—Michael J. Striker

[57] ABSTRACT

A packaging machine (10) for processing fold boxes (15) with integrated support frames (25) has respectively one raising element (47) moving along with each fold box (15), which raises the support frame (25) lying flat against the inside of the fold box (15). A support element (50) is furthermore associated with each raising element (47), which interlockingly supports the support frame (25) during the insertion of objects (30, 35) into the fold box (15).

7 Claims, 3 Drawing Sheets

FIG. 2
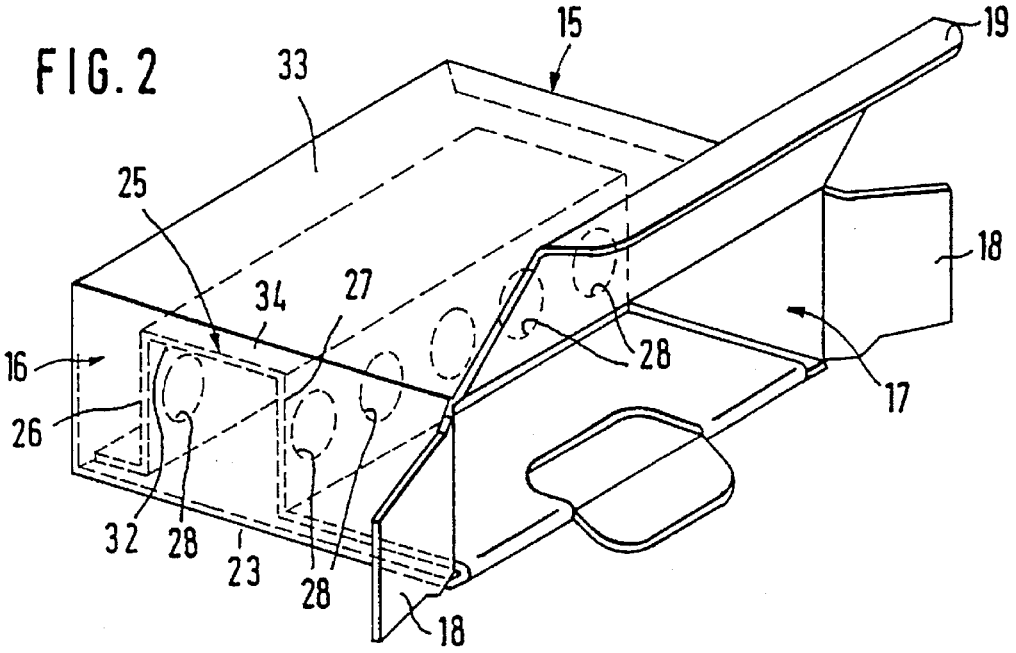
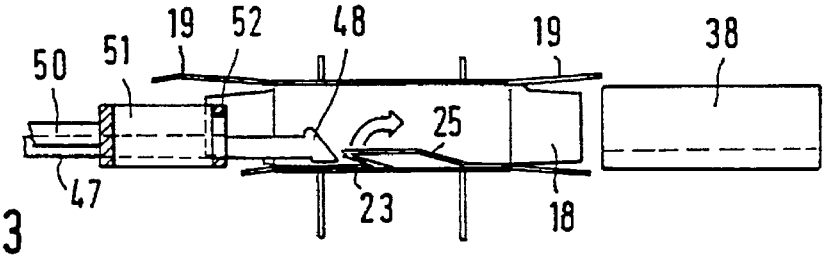
FIG. 3
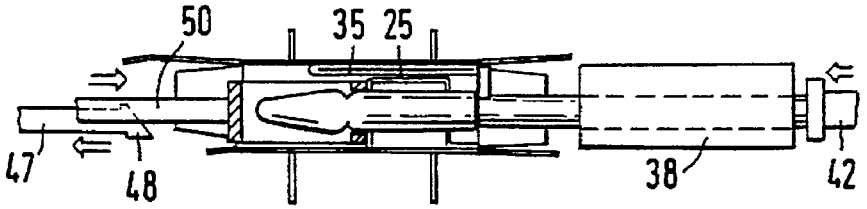
FIG. 4
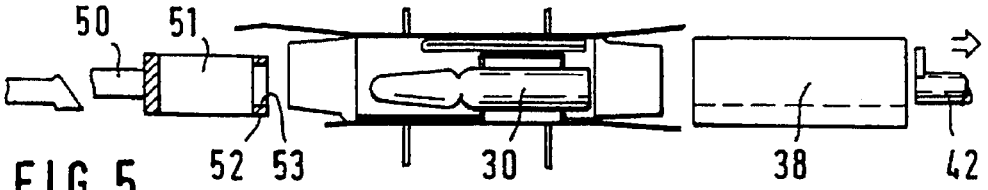
FIG. 5

PACKAGING MACHINE

PRIOR ART

The invention is based on a packaging machine in accordance with the preamble of claim 1. In such a packaging machine known, for example, from EP 0 465 437 A1, upright fold boxes which reveal an opening cross section are conveyed along a horizontal conveying path. Several blister strips, placed on top of each other and with a packing slip enclosing them in a U-shape, are respectively conveyed in a product bowl parallel and aligned with the fold boxes. The contents of the product bowls are pushed into the fold boxes by inserting slides associated with the product bowls and the fold boxes are subsequently closed. Packaging machines of this type are particularly suited for packing sturdy goods which completely fill the opening cross section. Fold boxes with an integrated support frame for packaging delicate objects, such as ampuls, vials and the like, now have become known from the German Utility Model Application G 93 04192.6, for example. The support frame is integrally connected with a wide interior wall of the folding box and, since it can be bent over flat against the interior wall, allows the flat transport and storage of such fold boxes. However, these fold boxes cannot be processed in the known packaging machine described above since, after putting the fold box upright, the support frame lies flat at least in part, and therefore the objects cannot be inserted into the receptacles for the object formed in the support frame.

It is therefore the object of the invention to disclose a packaging machine in which fold boxes with integrated support frames can also be processed.

ADVANTAGES OF THE INVENTION

In contrast to this, the packaging machine in accordance with the invention having the characterizing features of claim 1 has the advantage that fold boxes with integrated support frames can also be dependably processed.

Further advantages and advantageous embodiments ensue from the dependent claims and the specification. Dependable raising in connection with different support frame designs is achieved by means of the wedge-shaped design of the raising elements. The objects can be inserted into the support frame particularly well, if the latter is held by a support element during the insertion. Tilting of the objects during insertion can be prevented by a special embodiment of the inserting slides. Jamming of the support frame can be prevented by an appropriate embodiment of the raising elements.

DRAWINGS

An exemplary embodiment of the invention is represented in the drawings and will be explained in detail in the following description. FIG. 1 shows a section of the packaging machine in accordance with the invention in a simplified perspective view, FIG. 2 shows a fold box with an integrated support frame in a perspective view, FIGS. 3 to 5 represent cross sections through the packaging machine of FIG. 1 in different work phases, and FIG. 6 shows a cross section in accordance with FIG. 4 in an altered embodiment.

DESCRIPTION OF THE EXEMPLARY EMBODIMENT

Figure 1:
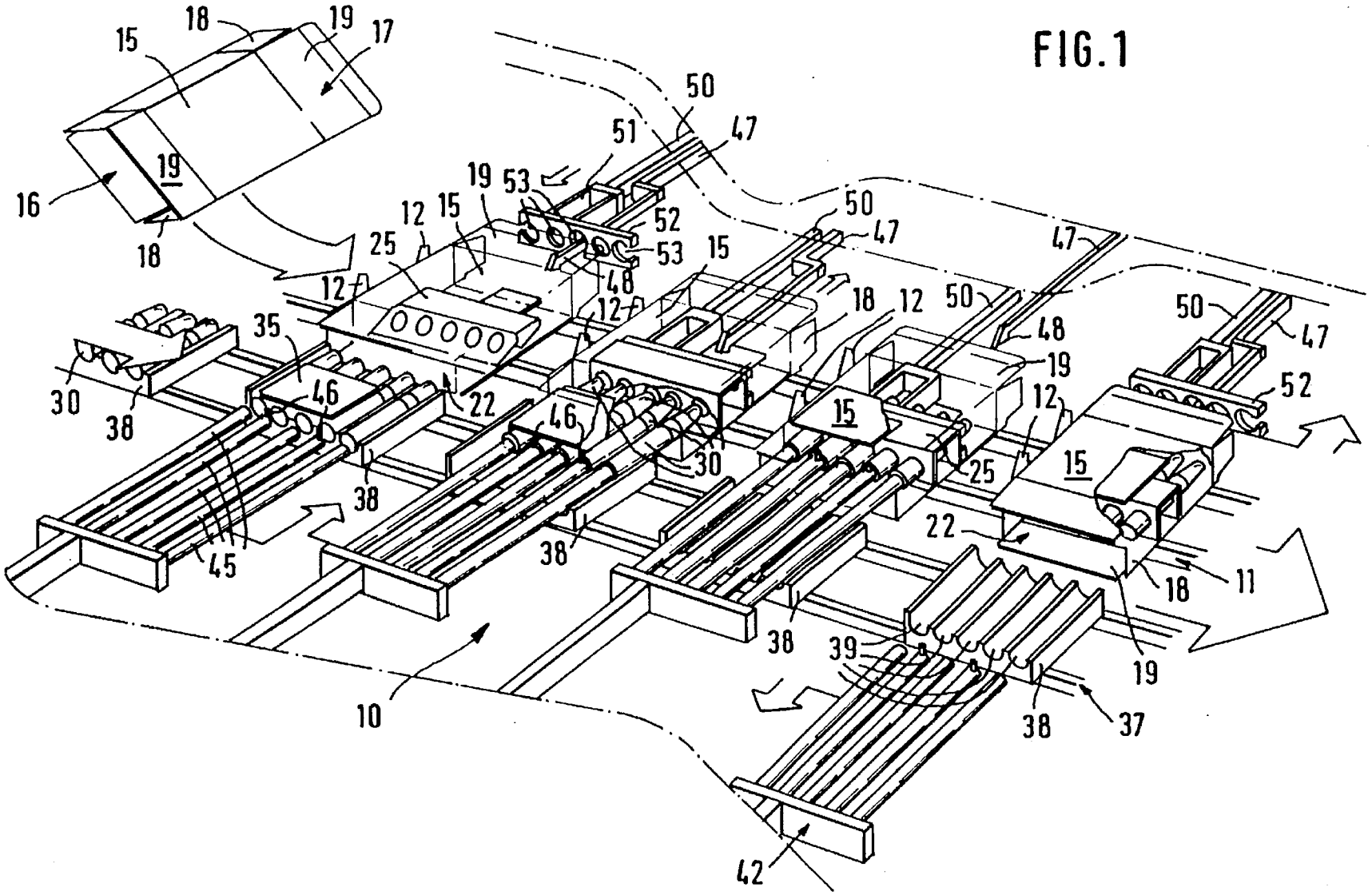

A horizontal conveying path of a packaging machine 10 is shown in FIG. 1, wherein fold boxes 15 are continuously conveyed between pushers 12 disposed at even distances on a conveyor belt 11. The fold boxes 15, which at first lie flat, are taken from a magazine stack by means of removal, raising and transfer devices (not shown), known per se, and are inserted with raised lateral walls between the pushers 12. On their two opposite ends 16, 17, the fold boxes 15 have closure flaps 18, 19, which are bent away in the section of the horizontal conveying path shown, by guide rails, also known and not shown, so that the full opening cross section 22 of the fold box 15 is open. Each fold box 15 (FIG. 2) has in its interior a support frame 25, integrally connected with a wide lateral wall 23 and having interlocking receptacles in the shape of openings 28 for sensitive objects such as ampuls 30 or vials, for example, in wall sections 26, 27 extending perpendicularly from the wide lateral wall 23. A pocket 34 is formed between an intermediate wall 32 connecting the wall sections 26, 27, and a second wide lateral wall 33 of the fold box 15, in which a folded packing slip 35 can be inserted.

Product bowls 38, in whose depressions 39 the ampuls 30, intended for a folding box 15, as well as the packing slip 35 placed on the ampuls 30, are conveyed, are arranged, aligned with the fold boxes 15 and moving along with the fold boxes 15, on a second conveyor belt 37. The arrangement of the ampuls 30 and the packing slip 35 in the product bowl 38 is such that they are aligned with the openings 28 or the pocket 34 when the support frame is raised.

An insertion device 42, aligned with each product bowl 38, is associated with the latter, whose insertion slides 45, adapted to the number and shape of the ampuls 30, can be moved crosswise to the conveying direction of the fold boxes 15 into the latter. Furthermore, two pins 46 used as a stop for the packing slip 35, are disposed on at least two insertion slides 45, which are respectively associated with a product bowl 38.

A raising element 47 is associated with each fold box 15 on the side opposite the insertion slides 45, which moves along with it and can be displaced, centered with its opening cross section 22, into the folding box 15. On its tip 48 facing the wall section 27 of the support frame 25, the pin shaped raising element 47 is embodied in a wedge-shape, so that the underside of the tip 48 approximately ends at the inside of the wide lateral wall 23.

A support element 50 can also be moved crosswise to the conveying direction of the fold box 15 with which it is associated. The support element 50 has a fork-shaped support 51 which is arranged approximately parallel with the pin-shaped raising element 47. The support 51 has at its tip a support face 52 with cutouts 53 adapted to the opening cross section 22 of the fold box 15 and to the openings 28 of the support frame 25. The cutouts 53 are of such a size that they have a larger opening than the openings 28 and can furthermore be penetrated by the tip 48 of the raising element 47.

The above described packaging machine 10 operates as follows:

The product bowls 38 equipped with the ampuls 30 and the packing slip 35 move along parallel and aligned with the raised fold boxes 15, which are continuously conveyed between the pushers 11. So that the ampuls 30 in particular can be pushed into the openings 28 formed in the support frame 25, the support frame, which still rests flat against the lateral wall 23 after the fold box 15 has been raised, must be raised, so that the two wall sections 26, 27 with the openings 28 project perpendicularly away from the lateral wall 23. For this purpose the raising element 47 is moved crosswise to the conveying direction of the fold box 15 into its opening 17

(FIG. 3). The wedge-shaped tip 48 of the raising element 47 catches the wall section 27 of the support frame 25, which faces it and is folded parallel with the lateral wall 23, and raises it together with the support frame 25.

As soon as the support frame 25 has been raised, the raising element 47 is moved back and the support element 50 is inserted into the opening 17 far enough so that its support face 52 places the entire surface of the support frame 25 against the wall section 27 (FIG. 4). In this position the openings 28 of the support frame 25 are aligned with the ampuls 30 in the product bowl 38. Now the inserting slides 45 of the insertion device 42 are moved crosswise to the conveying direction of the fold box 15 in such a way, that the ampuls 30 and the packing slip 35 are pushed through the opening 16 into the cutouts 28 of the support frame 25 or into the pocket 34. The support frame 25 is maintained in the intended position by the interlocking placement of the support face 52 of the support element 50 during the entire insertion of the ampuls 30 into the support frame 25. As soon as the inserting slides 45 have pushed the ampuls 30 into the intended position in the fold box 15, they and the support element 50 are moved out of the fold box 15 (FIG. 5). The fold box 15 is subsequently moved on to a closing installation for closing the closure flaps 18, 19.

Figure 6:
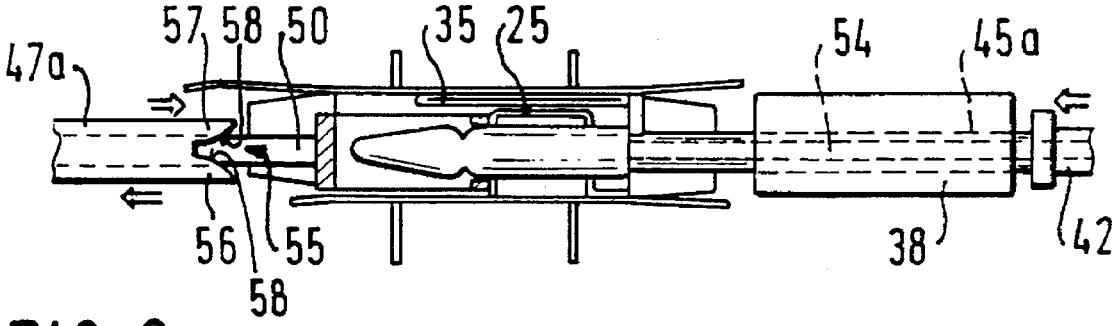

To ease the insertion of vials in particular, and of similar objects, whose diameter is almost constant in the area of their tops, the inserting slides **45*a* have been modified in FIG. 6 by a respective, concentrically arranged suction bore 54. The suction bores 54 which are connected with a vacuum source, not shown, terminate in the front faces of the inserting slides 45*a* facing the ampuls 30. If the suction bores 54 are charged with a vacuum during the insertion of the ampuls 30 into the fold box 15, the ampuls 30 are pulled by suction against the inserting slides 45*a* and are horizontally aligned with them. Tilting and thus jamming, for example, of the ampuls 30 against the support frame 25** is prevented during the insertion by means of this.

The raising element **47*a* furthermore has a U-shaped cross section with an opening 55 facing the support frame 25. The two legs 56, 57 of the raising element 47*a* flanking the opening 55 are respectively designed as wedge shapes. Their faces 58 facing the opening 55 are concavely shaped in the exemplary embodiment, however, they can also be flat-shaped, for example. During raising, the support frame 25 is guided by the upper leg 57** in such a way that it becomes also possible to raise support frames which are critical in the size of their sections or in their folding process.

In addition it should be pointed out that, depending on the design of the support frame 25 and the objects to be packaged, it would also be conceivable to replace the raising element 47, **47*a* and the support element 50 by a single element which takes on the functions of both elements 47 or 47*a* and 50. It is furthermore possible to omit a support element 50 if there is an appropriately stiff support frame 25, or with openings 28 of the support frame 25 in which the objects are disposed with play, and to raise the support frame 25 merely by means of a raising element 47, 47*a***.

We claim:

1. A packaging machine (10) for inserting objects (30, 35) into fold boxes (15) having an integrated support frame (25) with openings formed therein, which is initially disposed lying flat within the fold box, said machine comprising:

a horizontal conveying path, pushers (12) conveying the fold boxes (15) at equal distances along said horizontal conveying path;

product bowls (38) which feed the objects (30, 35) to be packaged and move along a portion of the conveying path of the fold boxes (15) and are aligned with them;

inserting slides (45, **45*a*) also moving along in alignment with the product bowls (38) and the pushers (12) over a portion of the conveying path and on a side of the fold boxes (15), which push respectively at least one object (30, 35) out of a product bowl (38) into a frame opening in a fold box (5) while they are aligned with the product bowl (38) and the fold boxes (15**) and which thereafter return into their initial position;

raising elements (47, **47*a*) disposed to move along on the side opposite the inserting slides (45, 45*a*) in alignment with the fold boxes and which, during said alignment with the fold boxes (15), are disposed to be moved crosswise to the conveying direction of the fold boxes (15) prior to and/or during the insertion of the objects (30, 35) by the inserting slides into the fold boxes (15) and which raise the initially flat-lying support frames (25) inside the raised fold boxes (15) so that said openings (28) formed in the support flames (25) are aligned flush with the objects (30, 35**) during their insertion.

2. A packaging machine in accordance with claim 1, characterized in that the raising elements (47, **77*a*) are at least partially embodied to be wedge-shaped at their tips (48) facing the support frame (25), so that the wedge-shaped area acts on the flat-lying wall (27) of the support frame (25) facing the raising element (47, 47*a***).

3. A packaging machine in accordance with claim 1, characterized in that a support element (50) for the support frame (25) is disposed in alignment with each raising element (47, **47*a*), which is in contact with the raised support frame (25) during the insertion of the objects (30, 35) into the support frame (25), and aligns its openings (28) with the objects (30, 35**).

4. A packaging machine in accordance with claim 3, characterized in that the raising element (47, **47*a*) and the support element (50) can be moved separately of each other crosswise in respect to the conveying direction of the fold boxes (15**).

5. A packaging machine in accordance with claim 3, characterized in that the support element (50) has a support face (52) adapted to the openings (28) of the support frame (25).

6. A packaging machine in accordance with claim 1, characterized in that the raising element (**47*a*) is embodied to be U-shaped in cross section and has two legs (56, 57), whose faces (58) facing the opening (55) of the raising element (47*a***) are concavely designed.

7. A packaging machine in accordance with claim 1, characterized in that the inserting slides (**45*a*) have suction bores (54) which terminate in the front faces of the inserting slides (45*a*) facing the objects (30**).

* * * * *